US006866519B2

(12) United States Patent
Fan et al.

(10) Patent No.: US 6,866,519 B2
(45) Date of Patent: Mar. 15, 2005

(54) ADAPTABLE RESILIENT PIN ASSEMBLY FOR BGA BASED IC ENCAPSULATION

(76) Inventors: Wei-Fang Fan, 1F., No. 46, Lane 1448, Jong Hwa Rd., Jwu Beei City (TW); Wan-Chuan Chou, No. 18, Lane 49, Shan Jean Rd., Sec. 1, Ell Shoei County (TW); Chin-Yi Chen, No. 707, Sec. 2, WuFu Rd., Hsinchu (TW)

( * ) Notice: Subject to any disclaimer, the term of this patent is extended or adjusted under 35 U.S.C. 154(b) by 0 days.

(21) Appl. No.: 10/615,909

(22) Filed: Jul. 10, 2003

(65) Prior Publication Data

US 2005/0009381 A1 Jan. 13, 2005

(51) Int. Cl.[7] ..... H01R 12/00
(52) U.S. Cl. ..... 439/66; 439/700
(58) Field of Search ..... 439/65–67, 70–73, 439/591, 331, 700, 482, 824, 91

(56) References Cited

U.S. PATENT DOCUMENTS 5,727,954 A * 3/1998 Kato et al. ..... 439/66
5,738,531 A * 4/1998 Beaman et al. ..... 439/71
5,880,590 A * 3/1999 Desai et al. ..... 324/757
6,341,962 B1 * 1/2002 Sinclair ..... 439/66
6,464,511 B1 * 10/2002 Watanabe et al. ..... 439/66
6,524,115 B1 * 2/2003 Gates et al. ..... 439/66

* cited by examiner

*Primary Examiner*—Gary Paumen
*Assistant Examiner*—Edwin A. Leon
(74) *Attorney, Agent, or Firm*—Dennison, Schultz, Dougherty & MacDonald

(57) ABSTRACT

An adaptable pin assembly for a BGA based IC encapsulation is disclosed. The pin assembly comprises has an upper cover including a plurality of longitudinal channels arranged in rows and columns for anchoring portions of a plurality of longitudinal, conductive, detachable, and resilient pins; and a lower cover coupled to the upper cover. The lower cover includes a plurality of longitudinal channels arranged in rows and columns for anchoring the remaining portions of the pins. In testing an encapsulated IC chip the pin assembly is sandwiched between the IC chip having a plurality of bottom tin balls and a circuit board of an IC test device, the tin balls are rested on the upper pins, and the circuit board is connected to the lower pins so as to form an electrical connection between the tin balls and the circuit board.

1 Claim, 9 Drawing Sheets

ADAPTABLE RESILIENT PIN ASSEMBLY FOR BGA BASED IC ENCAPSULATION

BACKGROUND OF THE INVENTION

1. Field of the Invention

The present invention relates to BGA (ball grid array) based IC (integrated circuit) encapsulation and more particularly to a highly adaptable resilient pin assembly used in a BGA based IC encapsulation.

2. Description of Related Art

Currently, a BGA based IC encapsulation is the dominant one of a variety of IC encapsulations. It has the advantages of having a relatively large number of pins produced per unit area (i.e., more features obtained), and less space occupied and less weight per group of pins (i.e., further reduction of IC chip size). In 1997, Intel Corp. had successfully conducted a reliability test on memory devices produced by the BGA based IC encapsulation. Also, such memory devices are used as flash memory. Moreover, many DRAM (dynamic random access memory) or Direct Rambus DRAM memories are manufactured by the BGA based IC encapsulation.

But whether an encapsulated IC chip is acceptable can only be determined by testing. As such, a suitable IC test device is required as shown in FIG. 1. Components of the prior IC test device are fixed in place. In other words, the IC test device has no replaceable parts. For example, CPU (central processing unit) and memories are formed on a circuit board by soldering. Also, contacts of the IC test device with IC chips are formed on the IC test device. In addition, the IC test device has no detachable components. Hence, a different IC test device is required if arrangement, spacing, or the number of tin balls of IC chips is different even when the same encapsulation is performed. In other words, it is poor in compatibility. Hence, a need for improvement exists.

SUMMARY OF THE INVENTION

It is an object of the present invention to provide an adaptable pin assembly for a BGA based IC encapsulation, comprising an upper cover comprising a plurality of longitudinal first channels arranged in rows and columns, each first channel including an upper first pin hole and a lower first spring receptacle in communication with the first pin hole; a lower cover coupled to the upper cover, the lower cover comprising a plurality of longitudinal second channels arranged in rows and columns, each second channel including an upper second spring receptacle and a lower second pin hole in communication with the second spring receptacle; and a plurality of longitudinal, conductive, detachable, and resilient pins each comprising an upper pin having a portion disposed in the first pin hole and the remaining portion projected from the first pin hole, a lower pin having a portion disposed in the second pin hole and the remaining portion projected from the second pin hole, and an intermediate resilient member in a space defined by the first and the second spring receptacles, wherein in testing an encapsulated IC chip the pin assembly is sandwiched between the IC chip having a plurality of bottom tin balls and a circuit board of an IC test device, the tin balls are rested on the upper pins, and the circuit board is connected to the lower pins so as to form an electrical connection between the tin balls and the circuit board.

In one aspect of the present invention the upper pin comprises a concave top.

In another aspect of the present invention the first spring receptacle has a diameter larger than that of the first pin hole and the second spring receptacle has a diameter larger than that of the second pin hole so that the resilient member can be stopped by a joining portion of the first pin hole and the first spring receptacle and a joining portion of the second pin hole and the second spring receptacle respectively.

In still another aspect of the present invention the upper pin, the lower pin, and the resilient member of each of the pins are integrally formed.

In a further aspect of the present invention the upper pin, the lower pin, and the resilient member of each of the pins are separately formed, the upper pin comprises a bottom collar urged against a top of the resilient member, and the lower pin comprises a top collar urged against a bottom of the resilient member.

The above and other objects, features and advantages of the present invention will become apparent from the following detailed description taken with the accompanying drawings.

DETAILED DESCRIPTION OF THE PREFERRED EMBODIMENTS

Figure 1:
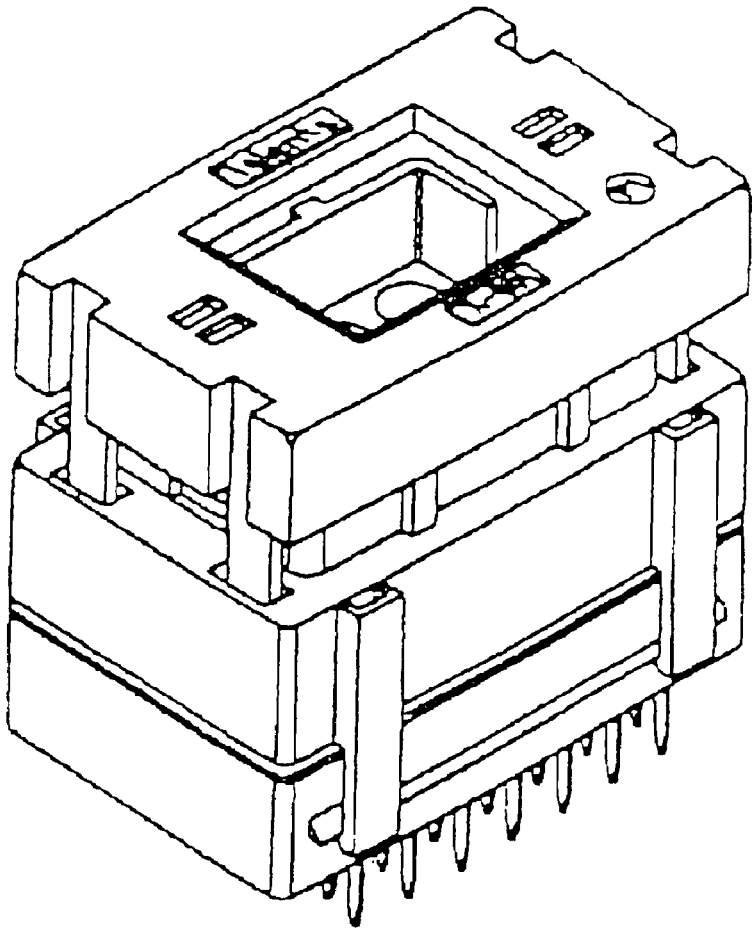
Fig.1 PRIOR ART
FIG. 1 is a perspective view of a conventional arrangement for testing an IC chip manufactured in a BGA based IC encapsulation.
Figure 2:
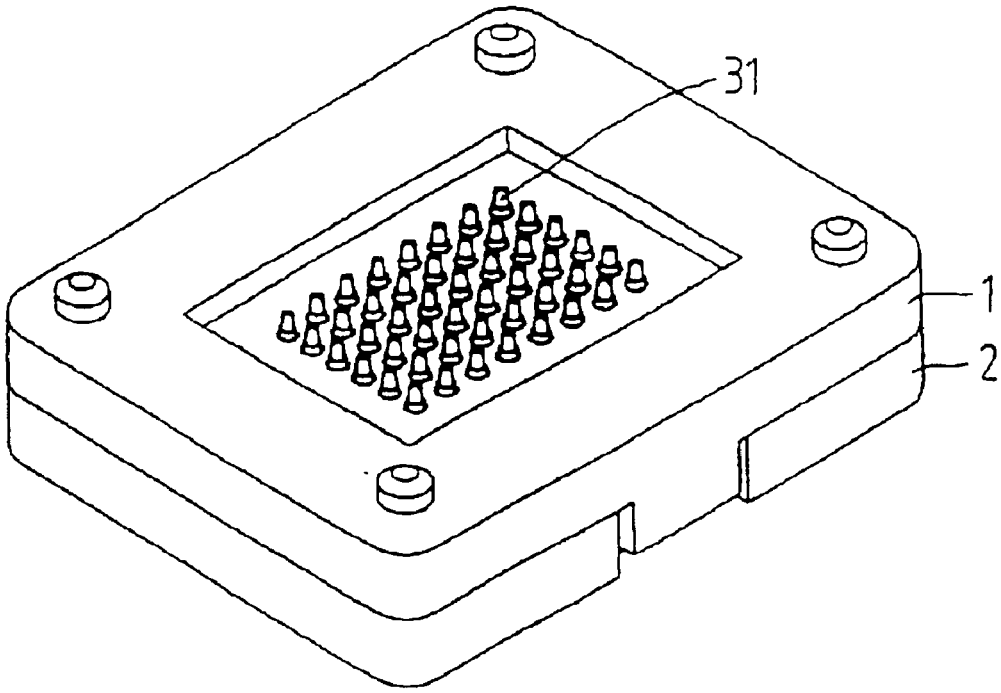
FIG. 2 is a perspective view of a first preferred embodiment of resilient pin assembly for BGA based IC encapsulation according to the invention.
Figure 3:
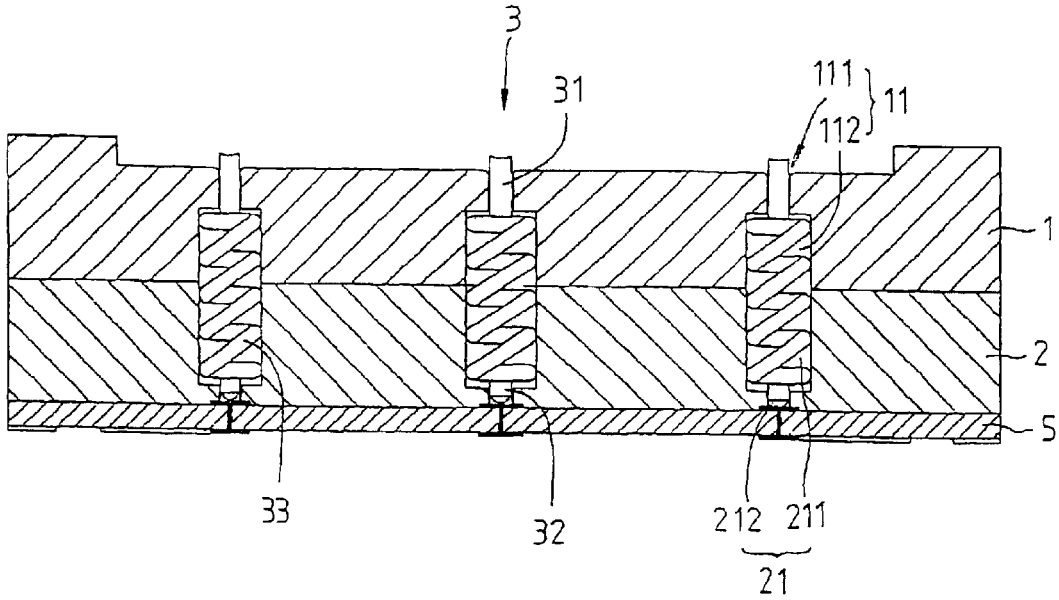
FIG. 3 is a schematic cross-sectional view of the FIG. 2.

Referring to FIGS. 2 and 3, a highly adaptable resilient pin assembly for BGA based IC encapsulation constructed in accordance with a first preferred embodiment of the invention is shown. The substantially parallelepiped pin assembly comprises an upper cover 1, a lower cover 2, and a plurality of longitudinal resilient pins 3. Each component will be described in detail below.

The upper cover 1 comprises a plurality of longitudinal first channels 11 arranged in rows and columns, each first channel 11 including an upper first pin hole 111 and a lower first spring receptacle 112 in communication with the first pin hole 111. Also, the first spring receptacle 112 has a diameter larger than that of the first pin hole 111. The lower cover 2 comprises a plurality of longitudinal second channels 12 arranged in rows and columns, each second channel 12 including an upper second spring receptacle 211 and a lower second pin hole 212 in communication with the second spring receptacle 211. Also, the second spring receptacle 211 has a diameter larger than that of the second pin hole 212. Each pin 3 is formed of conductive materials. The pin 3 is an integral part and comprises an upper pin 31, a lower pin 32, and an intermediate resilient member (e.g., spring) 33. Also, a concave well is formed on top of the upper pin 31.

In assembly, first insert the upper pin 31 upward through the first spring receptacle 112 and the first pin hole 111 until the resilient member 33 is stopped by the joining portion (i.e., shoulder) of the first pin hole 111 and the first spring receptacle 112. Next, insert the lower pin 32 downward through the second spring receptacle 211 and the second pin hole 212 until the resilient member 33 is stopped by the joining portion (i.e., shoulder) of the second spring receptacle 211 and the second pin hole 212. As such, the resilient member 33 is anchored in the space defined by the first and the second spring receptacles 112 and 211. Finally, use bolt and nut assemblies to fasten the upper and the lower covers 1 and 2 together. It is seen that both open ends of the upper and the lower pins 31 and 32 are slightly projected from the top surface of the upper cover 1 and the bottom surface of the lower cover 2 respectively. Further, the upper pin 31 can be retracted by compressing the resilient member 33 to be flush with the opening of the first pin hole 111 if an object having a sufficient weight is placed thereon. A similar condition is occurred on the lower pin 32. It is understood that both the upper and the lower pins 31 and 32 can return to normal positions as shown in FIGS. 2 and 3 if the objects are removed.

Figure 4:
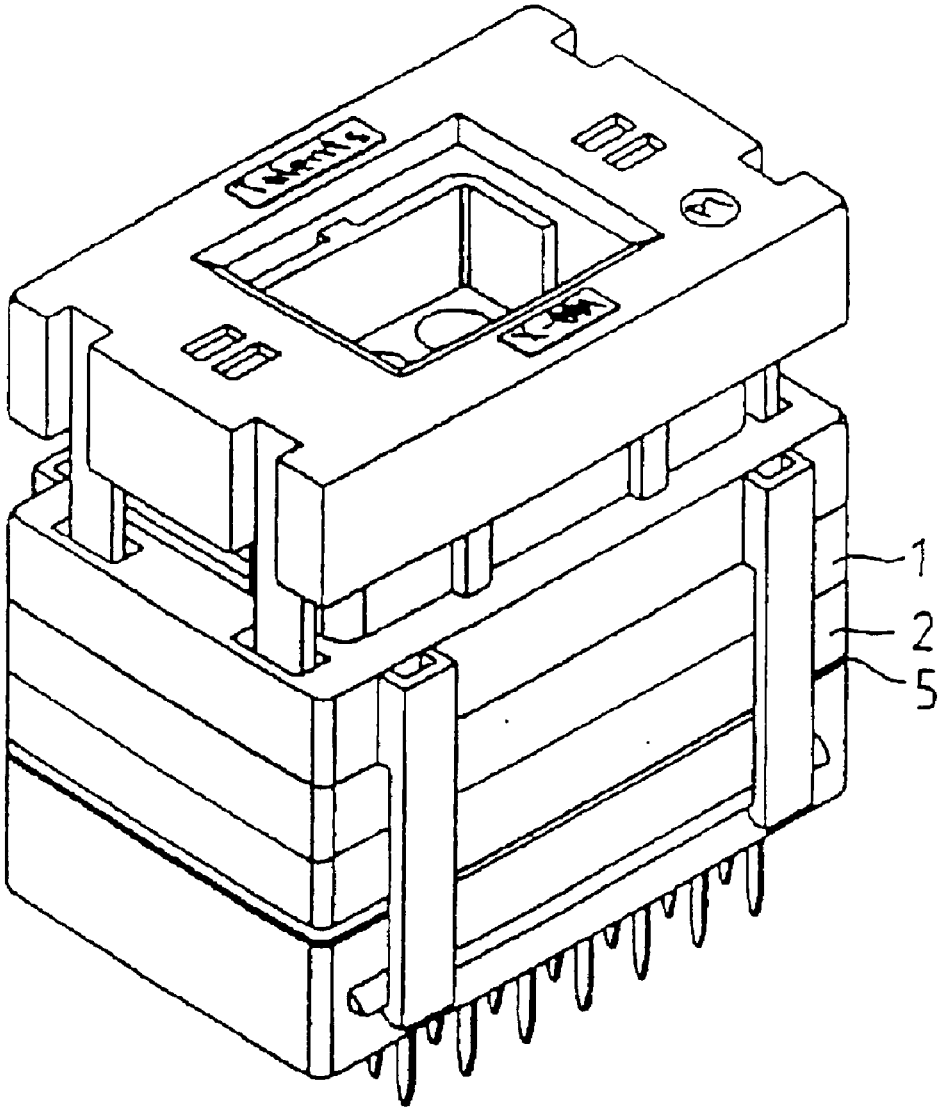
FIG. 4 is a perspective view of the pin assembly mounted between an IC chip and a circuit board of an IC test device.
Figure 5:
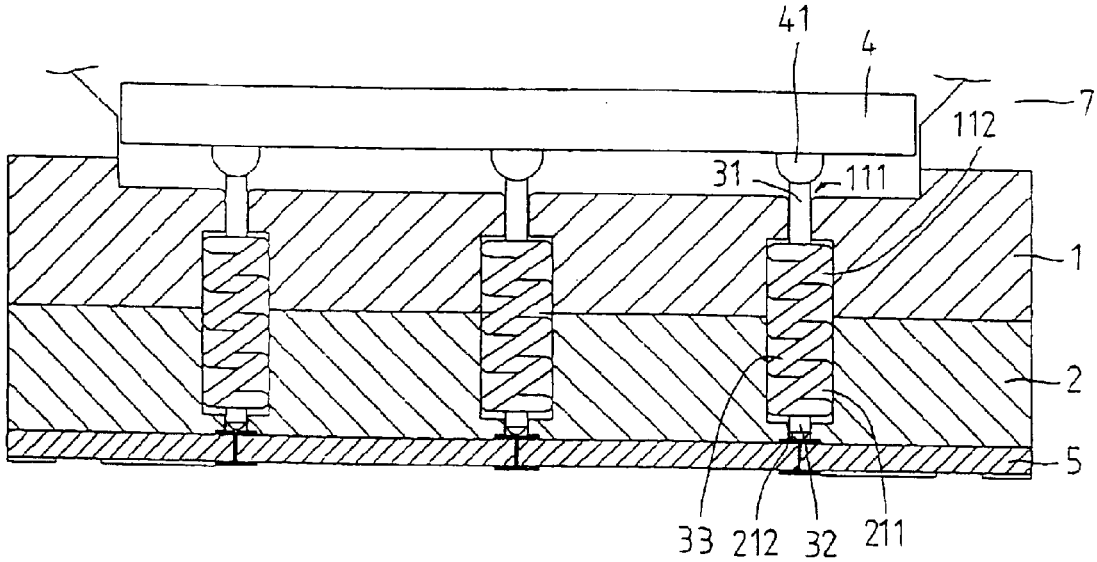
FIG. 5 is a schematic cross-sectional view of a portion of the FIG. 2.

Referring to FIGS. 4 and 5, the pin assembly is sandwiched between an IC chip 4 and a circuit board 5 of an IC test device 7. As shown, a plurality of tin balls 41 on a bottom of the IC chip 4 are rested on the upper pins 31 and the circuit board 5 of the IC test device 7 is connected to the lower pins 32. As such, an electrical connection between the tin balls 41 and the circuit board 5 is formed. Also, the concave well of the upper pin 31 is substantially conformed to the spherical surface of the tin ball 41. As a result, a minimum damage to the tin ball 41 is achieved due to the smooth contact.

Figure 6:
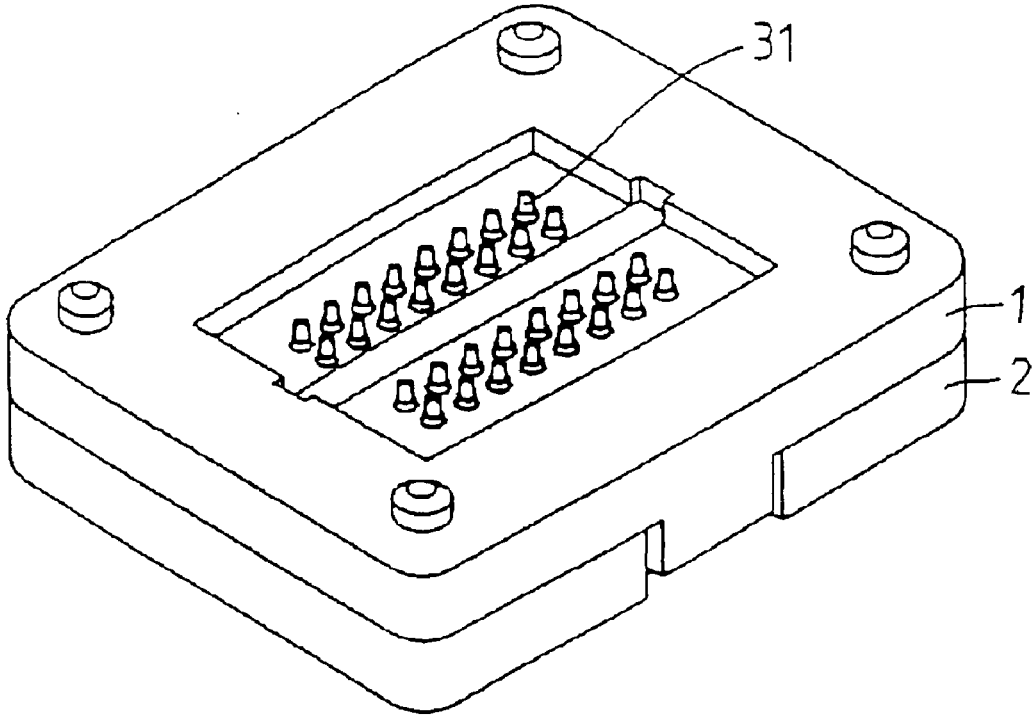
FIG. 6 is a perspective view of a second preferred embodiment of resilient pin assembly for BGA based IC encapsulation according to the invention.
Figure 7:
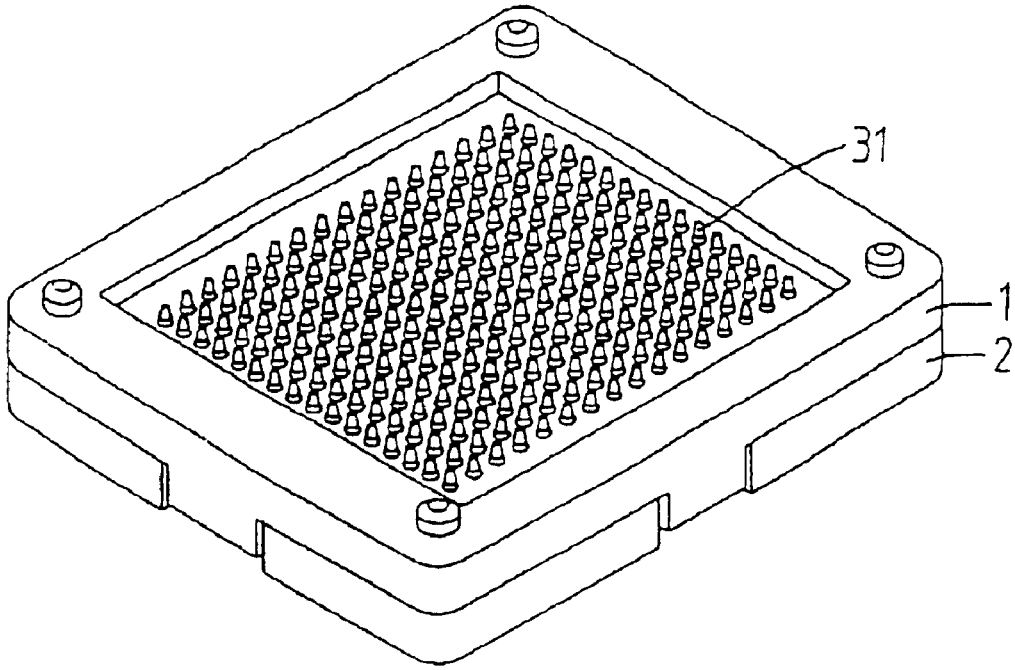
FIG. 7 is a perspective view of a third preferred embodiment of resilient pin assembly for BGA based IC encapsulation according to the invention.
Figure 8:
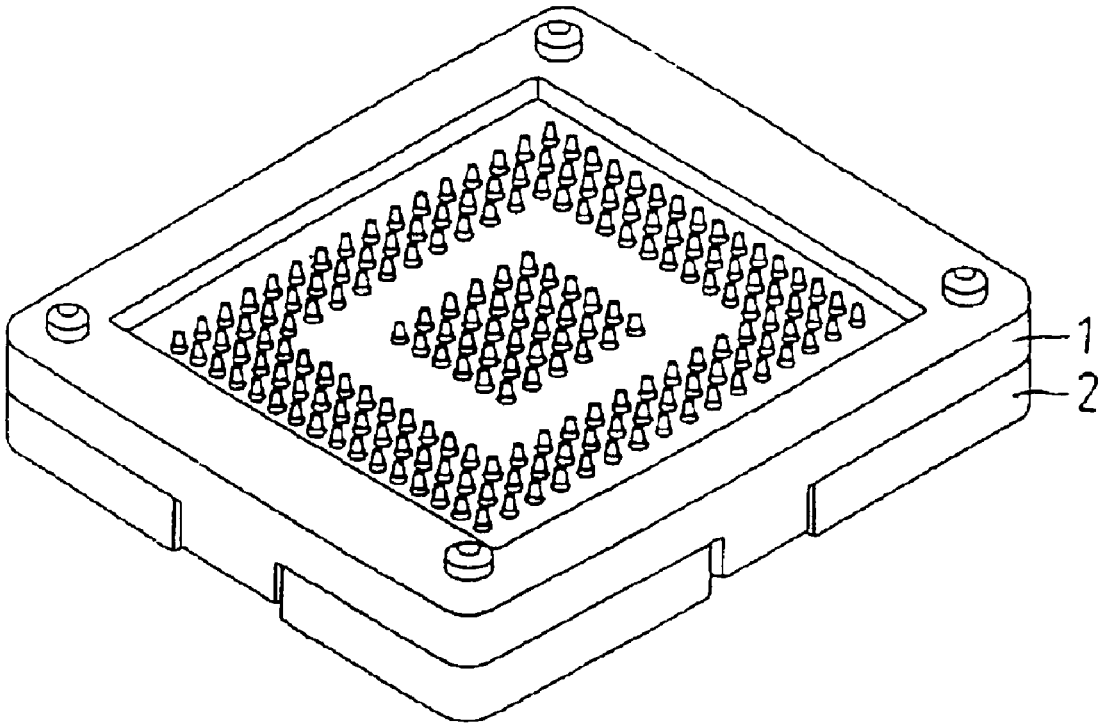
FIG. 8 is a perspective view of a fourth preferred embodiment of resilient pin assembly for BGA based IC encapsulation according to the invention.

Referring to FIGS. 6, 7, and 8, second, third, and fourth preferred embodiments of the pin assembly according to the invention are shown. In any of the above preferred embodiments, the arrangement of the pins 3 including the upper pins 31, the lower pins 32, and the resilient members 33 can be changed so as to conform to the number, spacing, and pattern of the tin balls. This enables the invention to be adapted to various IC chips in testing. In other words, a simple replacement of a suitable pin assembly is sufficient in testing one of a variety of IC chips.

Figure 9:
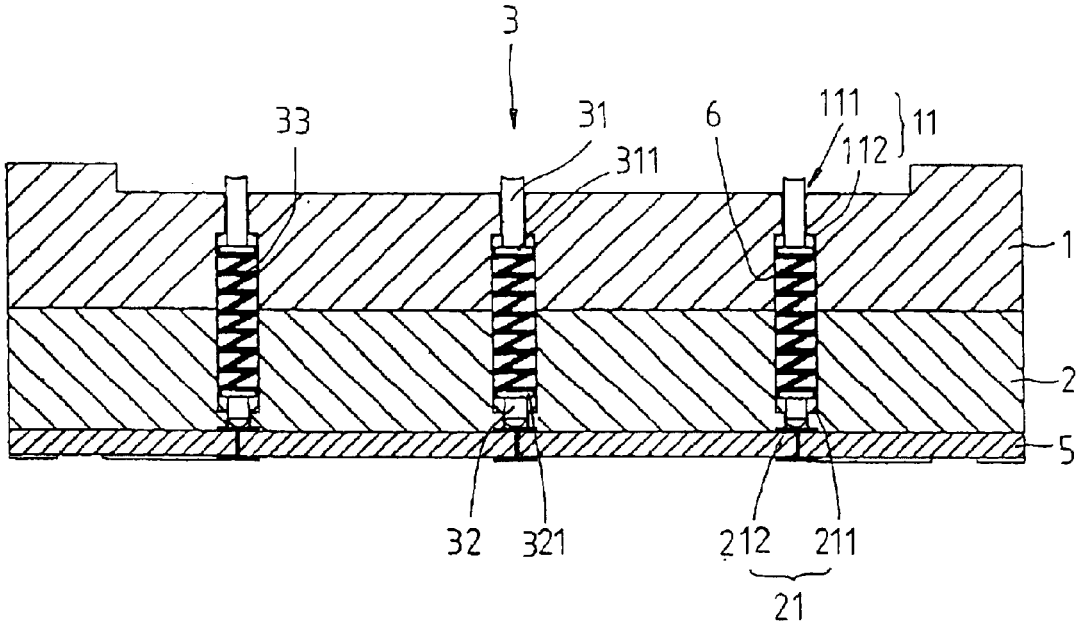
FIG. 9 is a schematic cross-sectional view of any of the above embodiments for illustrating another configuration of the pin assembly having separate components.

Referring to FIG. 9, there is shown another configuration of the pin assembly applicable to any of the above embodiments. The characteristic of another configuration is that components of the pin assembly are separate in which a collar 311 is formed on a bottom end of the upper pin 31 urged against the top of the resilient member 33 and another collar 321 is formed on a top end of the lower pin 32 urged against the bottom of the resilient member 33 respectively. Other components are the same as that described above. Thus a detailed description thereof is omitted herein for the sake of brevity.

While the invention herein disclosed has been described by means of specific embodiments, numerous modifications and variations could be made thereto by those skilled in the art without departing from the scope and spirit of the invention set forth in the claims.

What is claimed is:

1. A substantially parallelpiped pin assembly for a BGA based IC encapsulation comprising:

an upper cover comprising a plurality of longitudinal first channels arranged in rows and columns, each channel including an upper first pin hole and a lower first receptacle in communication with the first pin hole and the first spring receptacle having a diameter larger than that of the first pin hole;

a lower cover coupled to the upper cove, the lower cover comprising a plurality of longitudinal second channels arranged in rows and columns, each second channel including an upper second spring receptacle and a lower second pin hole in communication with the second spring receptacle and the second spring receptacle having a diameter larger than that of the second pin hole;

a plurality of longitudinal, conductive, detachable, and resilient pins each comprising an upper pin having a portion disposed in the first pin hole and the remaining portion projected from the first pin hole, a lower pin having a portion disposed in the second pin hole and the remaining portion projected from the second pin hole, and a single intermediate resilient spring in a space defined by the first and the second spring receptacles, and the intermediate resilient spring being stopped by a joining portion of the first pin hole and the first spring receptacle and a joining portion of the second pin hole and the second spring receptacle respectively, and wherein the upper pin, the lower pin and the intermediate resilient spring of each of the pins are separately formed and the upper pin includes a bottom collar against a top of the resilient member and the lower pin comprising a top collar urged against a bottom of the resilient member respectively;

wherein in testing an encapsulated IC chip, the pin assembly is sandwiched between the IC chip having a plurality of bottom tin balls having a spherical surface and a circuit board of an IC test device, the tin balls are rested on the upper pins, and the circuit board is connected to the lower pins so as to form an electrical connection between the tin balls and the circuit board; and, wherein each of the upper pins comprises a concave top conformed to the spherical surfaces of the bottom tin balls.

* * * * *